United States Patent [19]

Pozar

[11] 4,142,435

[45] Mar. 6, 1979

[54] PICKUP ASSEMBLY FOR STRINGED INSTRUMENT

[76] Inventor: Cleve F. Pozar, 125 Green St., Cambridge, Mass. 02139

[21] Appl. No.: 838,627

[22] Filed: Oct. 3, 1977

[51] Int. Cl.[2] ..... G10H 3/08

[52] U.S. Cl. ..... 84/1.15; 84/1.16

[58] Field of Search ..... 84/1.01, 1.14, 1.15, 84/1.16, DIG. 24

[56] References Cited

U.S. PATENT DOCUMENTS

| | | | |
|---|---|---|---|
| 3,288,906 | 11/1966 | Burns | 84/1.15 |
| 3,544,616 | 12/1970 | Broussard | 84/1.16 |
| 3,571,483 | 3/1971 | Davidson | 84/1.16 |
| 3,869,952 | 3/1975 | Rowe | 84/1.16 |
| 3,911,777 | 10/1975 | Rendell | 84/1.16 |

*Primary Examiner*—Robert K. Schaefer
*Assistant Examiner*—William L. Feeney
*Attorney, Agent, or Firm*—Wolf, Greenfield & Sacks

[57] ABSTRACT

An array of magnetic pickup coils are mounted by a support assembly secured to the bridge of a stringed musical instrument. The assembly is preferably for use with a base violin or cello and is easily adjustable relative to the strings. The support assembly for the coils permits adjustment of the coils along each string, adjustment between each coil and its associated string, adjustment of the coil so as to center on the string and proper planar orientation between coil and string.

14 Claims, 6 Drawing Figures

PICKUP ASSEMBLY FOR STRINGED INSTRUMENT

BACKGROUND AND SUMMARY OF THE INVENTION

The present invention pertains to a pickup assembly which preferably comprises an array of pickup coils for use with a stringed instrument. Although, in the preferred embodiment the pickup assembly is for use with a base violin, cello or the like instrument, the invention may also be adapted in a somewhat smaller form for use with other stringed instruments such as a violin or viola. The invention pertains more particularly to a support assembly for the pickup array providing easy adjustment in a number of planes relative to the strings.

The supporting of pickup transducers adjacent to the strings of a stringed musical instrument is shown in the prior art. Representative prior art patents include U.S. Pat. Nos. 3,715,446; 3,571,483; 3,249,677; and 3,544,696. The prior art patents show many different constructions for the pickups but few of these are readily adaptable for use with larger stringed instruments such as a base violin, and furthermore, these known pickups do not provide sufficient adjustability of the pickup relative to the strings. In accordance with the present invention and in particular in association with a bass violin or cello, it has been found quite desirable to provide adjustability of the pickups along the strings. By providing this adjustability of the pickups essentially toward and away from the bridge from which the pickups are supported in accordance with the invention there is then provided greater latitude in the tonal quality of the sounds that are picked up. Depending upon the type of music that is being played, it may be desirable to have the pickup array closer to the bridge thus picking up fewer harmonics or moving it further from the bridge toward the finger board when additional harmonics are desired.

Accordingly, one object of the present invention is to provide an improved pickup assembly for a stringed instrument preferably supported from the bridge of the instrument and which permits easy adjustment of the pickup along the strings to provide different tonal quality sound reproductions.

Another object of the present invention is to provide a pickup assembly in accordance with the previous object and which also provides adjustment between each pickup coil and its associated string, adjustment of the coil so as to center the coil on the string and proper planar orientation between the coil and string.

A further object of the present invention is to provide a pickup assembly preferably for the larger variety of stringed instrument such as a bass violin and which essentially and easily provides three-dimensional adjustment of the pickup transducers in relation to the associated strings.

Still another object of the present invention is to provide an improved construction for the magnetic pickup coil itself.

To accomplish the foregoing and other objects of this invention there is provided an improved pickup assembly for a stringed musical instrument. In the disclosed embodiment, the instrument with which the invention is used is a base violin. The pickup assembly comprises a plurality of pickup transducers and means for supporting these transducers in a spaced array. A bass violin typically has four strings and thus there are preferably four pickup transducers, one associated with each string of the instrument. In the preferred construction, the means for supporting the transducers comprise individual support posts for each transducer with all of the posts commonly supported from a slotted support bracket which is in turn pivotally supported from a second slotted, U-shaped bracket. The assembly of this invention also comprises a means for mounting the transducer supporting means from the instrument adjacent the bridge of the instrument with the transducers disposed between the instrument body and strings. In the preferred construction the mounting means comprise a securing plate and associated screws or bolts for mounting the second bracket to the bridge of the instrument.

The support posts for each transducer move in a slot on the first bracket so that each transducer may be centered with regard to its associated string. This first slotted bracket is also pivotal so that the top surface of each transducer may be properly oriented in parallel arrangement with its associated string. The distance between the transducer and string is easily adjusted by movement of the post toward and away from the string. An important adjustment is provided by moving the first bracket relative to the stationary second bracket so as to move the array of transducers to different positions between the bridge and finger board depending upon the desired tonal quality.

DESCRIPTION OF THE DRAWINGS

Numerous other objects, features and advantages of the invention should now become apparent upon a reading of the following detailed description taken in conjunction with the accompanying drawings, in which.

DETAILED DESCRIPTION

Figure 5:
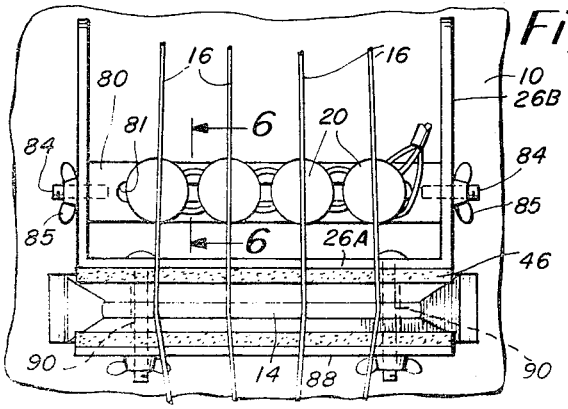
FIG. 5 is a front elevation view similar to that shown in FIG. 1 for an alternate embodiment of the invention.
Figure 6:
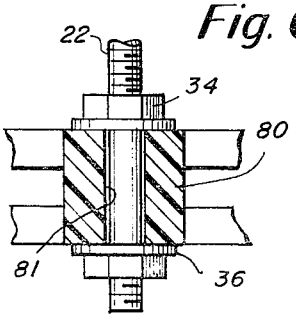
FIG. 6 is a cross-sectional view taken along line 6—6 of FIG. 5.

FIGS. 1–4 show one embodiment of the present invention used with a bass violin. FIGS. 5 and 6 show a slightly different embodiment of the invention which may also be used with the same type of instrument. Although there is described herein an assembly that is preferably used with a larger variety of stringed instrument, the invention may also be applied in a smaller size to other stringed instruments such as a guitar or violin.

Figure 1:
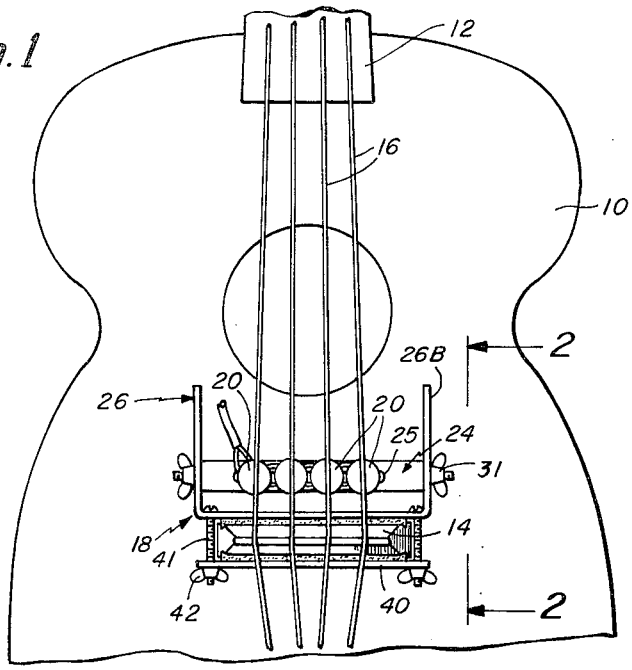
FIG. 1 is a front elevation view of the pickup assembly of this invention secured to a stringed musical instrument.
Figure 2:
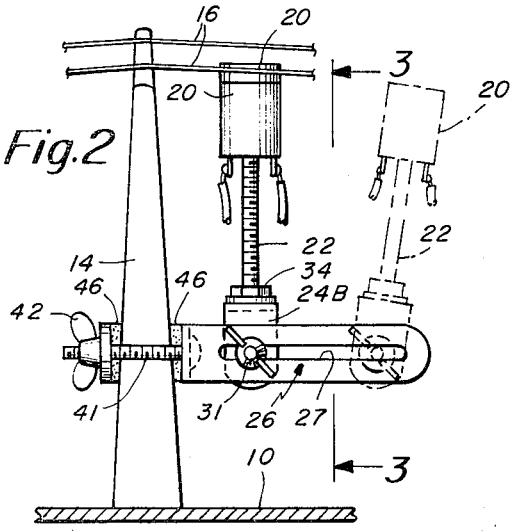
FIG. 2 is a cross-sectional view taken along line 2—2 of FIG. 1.
Figure 3:
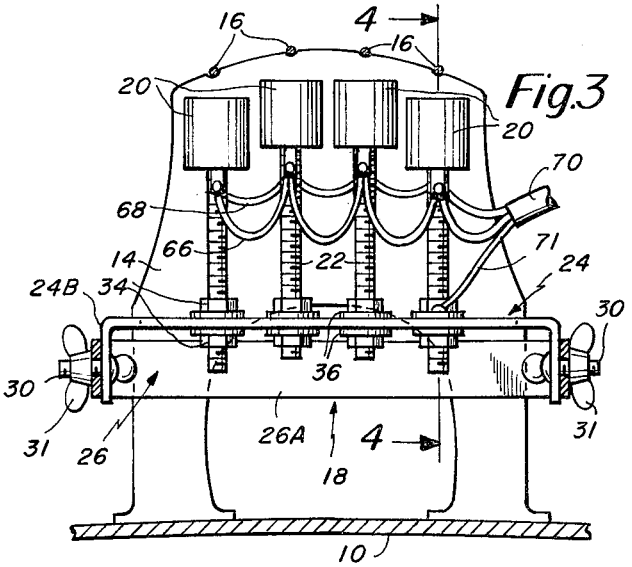
FIG. 3 is a further cross-sectional view taken along line 3—3 of FIG. 2 showing the string to pickup adjustability.

In FIGS. 1–4 there is shown the body 10 of a stringed musical instrument such as a base violin. The body supports a neck having a finger board 12 and a bridge 14 conventionally supported from the body of the instrument. FIG. 1 shows a plurality of strings 16 extending along the fingerboard 12 and supported at one point by the bridge 14 which is usually notched as shown in FIG. 3 to hold the strings 16 in a fixed position.

The assembly 18 of this invention is shown mounted to the bridge 14 and comprises a plurality of magnetic pickup transducers 20, a corresponding plurality of threaded support posts 22, a first slotted bracket 24, and a second slotted bracket 26. The detail of each transducer 20 is discussed in more detail hereinafter with reference to FIG. 4. Each support post 22 comprises a part of a conventional flat head bolt shown in FIG. 4 as also having a support head 23. The bracket 24 comprises an elongated main wall section 24A, and opposite flange ends 24B which are bent at a right angle relative to the main wall section 24A, as clearly depicted in FIG. 3. The end flanges 24B each have holes for receiving the bolt 30 and associated butterfly nut 31.

The main wall section 24A of the bracket 24 supports the support posts 22 in the elongated slot 25. In order to fix the support posts in the proper position, each post has associated therewith a pair of nuts 34 and associated washers 36. Each of the posts 22 is threaded therealong so as to provide adjustment along essentially the entire length of each post. Usually, however, the posts are in a position substantially as shown in FIG. 3. The nuts 34 may be jointly loosened or tightened against the brackets 24 in order to either change the position of the transducer 20 relative to its associated string 60 or lock the transducer in a desired position.

The second bracket 26 includes a main section 26A and end sections 26B which are disposed at right angles to the main section 26A as depicted in FIG. 1. Each of the end sections 26B is provided with an elongated slot 27 as shown in FIG. 2 for receiving on either side the securing bolts 31. The main section 26A of the bracket 26 secured against one side of the bridge 14 so that the bracket 26 extends toward the fingerboard. In order to secure the assembly in place there is also provided a support plate 40 and another pair of securing bolts 41 each with an associated butterfly nut 42. In order to reduce the vibration of the assembly a foam padding 46 is provided on either side of the bridge 14 as depicted in FIG. 2. The bracket 26 is secured in position by tightening the wing nuts 42 and is usually maintained in this fixed position about the bridge. The principal adjustments are provided by manipulation of the nuts 34 and of the wing nuts 31.

The proximity of each of the transducers to its associated string is adjusted by releasing the nuts 34 so that the posts can be moved to the desired position so that there is the proper spacing between the transducer and its associated string. The nuts 34 may then be tightened against the bracket 24. The centering of the transducer relative to the string is accomplished again by loosening the nuts 34 so that the post 22 can be moved along the slot 25 to the desired position. FIG. 3 shows each of the transducers 20 centered in relationship to its associated string 16.

The bolts 30 which pass through both the brackets 24 and the bracket 26 may be loosened for tilting the bracket 24. In FIG. 2 there is shown in solid, one position of the transducer and support post. It is noted, however, that the top of the transducer 20 is not exactly in parallel arrangement with the string 16. However, by loosening the nuts 31 the entire bracket 24 may be tilted such as to the position shown in dotted in FIG. 2 so as to provide substantially parallel arrangement with the top of the transducer and its associated string. Furthermore, as shown in dotted in FIG. 2 the transducer and its associated support may be moved along the slot 27 so as to move the entire array of transducers from a position close to the bridge to a position more remote from the bridge and toward the fingerboard.

For a cleaner tonal quality with fewer harmonics, it is more desirable to have the bracket 24 mounted close to the bridge 14. Also, if the instrument is to be bowed it is desirable to have the transducers disposed closer to the bridge 14. For other types of playing such as for modern music it may be desirable to detect harmonics in addition to the fundamental and thus the bracket 24 and its associated array of transducers may be moved away from the bridge 14 such as to a position shown in dotted in FIG. 2.

Figure 4:
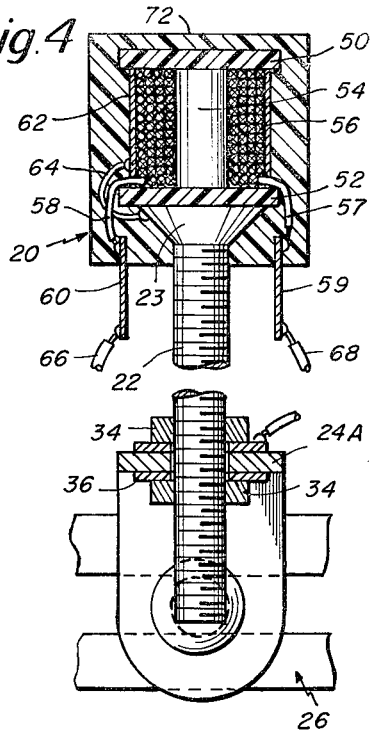
FIG. 4 is a cross-sectional view taken along line 4—4 of FIG. 3 showing the detail of one of the pickup transducers.

FIG. 4 shows the transducer of this invention which employs the bolt head 23 as a key means of support. The transducer comprises insulating discs 50 and 52 the bottom one of which is secured to the top of the head 23 such as by being epoxy glued thereto. A permanent magnet 54 extends between the discs and may have a length of approximately ½ inch, being about ¼ inch diameter. The magnetic core 54 is then wound with insulated magnetic wire 56 which may be 40 gauge Belden wire. The wire ends 57 and 58 connect respectively to terminal strips 59 and 60. In order to shield the coil of wire there is provided an aluminum foil layer 62 that may be wound in a number of layers about the previously wound wire 56. An additional connecting wire 64 connects from the layer 62 to the bolt head 23. Further wire sections 66 and 68 couple from the terminal strips 60 and 59, respectively, and couple between transducers as depicted in FIG. 3, finally connecting to a common cable 70. Each transducer also has its ground connection coupled by way of its associated support post. FIG. 3 also shows the common ground wire 71 coupling in the cable 70. The electrical connections may then connect to an amplifier or to an amplifier by way of a mixer circuit.

The transducer shown in FIG. 4 is preferably constructed with a hard epoxy protective layer 72. This encapsulates the transducer. In order to provide this encapsulation a mold is used with the transducer actually being formed in the position inverted from FIG. 4.

FIGS. 5 and 6 show a slightly different embodiment of the invention. In the embodiment of FIGS. 1–4 the brackets 24 and 26 are preferably constructed of a light metal such as aluminum. In the embodiment of FIG. 5 the bracket 26 may be constructed of aluminum but the bracket 24 is replaced by the solid square-shaped, plastic bar 80 provided with an elongated slot 81. FIG. 6 shows a cross-sectional view through the bar 80 with the slot 81 accommodating one of the posts 82 for supporting a transducer. For supporting the bar 80 there may be provided studs 84 permanently extending from either end of the bar. These studs extend through the slots 27 and the bar is secured by wing nuts 85 as in the embodiment of FIGS. 1–4. Because this alternate embodiment employs a plastic support bar 80, it may be necessary to run separate ground wires between each of the transducers. The embodiment of FIGS. 5 and 6 also reduces the width of the assembly. In FIG. 1 it is noted that the bracket 26 extends a substantial distance either side of the strings 16. However, in the embodiment of FIG. 5 the length of the wall section 26A has been reduced so that it is comparable to the width of the bridge 14. The plate 88 is also about the same width as the bridge 14. In this embodiment the securing bolts 90 extend through the open area of the bridge (see FIG. 3).

What is claimed is:

1. A pickup assembly for a stringed musical instrument comprising;

a plurality of pickup transducers, means for supporting said transducers in a spaced array with a transducer associated with a corresponding string, and means for mounting said transducer supporting means from the bridge of the instrument with the transducers disposed intermediate the instrument body and strings, said means for supporting including means for releasably supporting each transducer permitting the transducer to be moveable along the associated string and locked in any one of a number of positions along the string.

2. A pickup assembly as set forth in claim 1 wherein said means for mounting includes a bracket having means extending toward the fingerboard of the instrument defining a track along which the means for supporting may be moved.

3. A pickup assembly as set forth in claim 2 wherein said means for supporting includes a bracket having ends moveable along the track and means for locking the transducers in a fixed position along the strings from the bridge.

4. A pickup assembly for a stringed musical instrument comprising;

a plurality of pickup transducers, means for supporting said transducers in a spaced array with a transducer associated with a corresponding string including a support bracket and a plurality of posts each for supporting a transducer, each post supported from said support bracket with all posts extending substantially in parallel to each other, and means for mounting said transducer supporting means from the instrument adjacent the bridge of the instrument with the transducers disposed intermediate the instrument body and strings including a mounting bracket for holding the ends of the support bracket and securing the support bracket to the bridge of the instrument, said means for supporting including means for releasably supporting each transducer permitting the transducer to be movable along the associated string and locked in any one of a number of positions along the string.

5. A pickup assembly as set forth in claim 4 wherein said support bracket has an elongated slot for receiving the posts, each post having locking means associated therewith and being threaded to permit adjustment of each post in the direction of its associated string.

6. A pickup assembly as set forth in claim 5 wherein the support bracket has a solid shape having the slot extending therethrough.

7. A pickup assembly as set forth in claim 5 wherein the support bracket has turned ends.

8. A pickup assembly as set forth in claim 4 wherein said mounting bracket has a pair of ends extending in the direction between the bridge and fingerboard with each end slotted to receive the ends of the support bracket to permit adjustment of the transducer array along the strings, and means for locking the relative positions of the support and mounting brackets.

9. A pickup assembly as set forth in claim 8 wherein said means for mounting also includes a mounting plate, pad means and securing means for securing the mounting bracket on one side of the bridge and the mounting plate on the other side of the bridge with the pad means between the mounting means and bridge to reduce vibrations.

10. A pickup assembly as set forth in claim 1 wherein said transducers each comprise a magnet, a number of turns of wire about the magnet, insulating discs for supporting the magnet and a shield wound about the wire turns.

11. A pickup assembly as set forth in claim 4 wherein said posts each have a head for supporting the transducer.

12. A pickup assembly as set forth in claim 1 wherein said means for supporting comprises means for permitting the adjusting of the distance between transducer and string and, means for adjusting the centering of the transducer relative to its associated string.

13. A pickup assembly as set forth in claim 1 wherein said mounting means includes means for retaining the supporting means permitting sliding thereof along the bridge.

14. A pickup assembly for a stringed musical instrument comprising;

a plurality of pickup transducers, a support bracket, a plurality of posts each for supporting a transducer with each transducer associated with at least one string, each post supported from said support bracket with all posts extending substantially in parallel to each other, and a mounting bracket for holding the ends of the support bracket and securing the support bracket to the bridge of the instrument.

* * * * *